United States Patent [19]

Nishikawa

[11] 4,420,547

[45] Dec. 13, 1983

[54] PHOTOSENSITIVE MEMBER FOR ELECTROPHOTOGRAPHY HAVING ULTRAVIOLET ABSORPTION LAYER

[75] Inventor: Masaji Nishikawa, Hachioji, Japan

[73] Assignee: Olympus Optical Company Ltd., Tokyo, Japan

[21] Appl. No.: 303,867

[22] Filed: Sep. 21, 1981

[30] Foreign Application Priority Data

Oct. 16, 1980 [JP] Japan ..... 55-143692

[51] Int. Cl.[3] ..... G03G 5/10

[52] U.S. Cl. ..... 430/57; 430/67; 430/66

[58] Field of Search ..... 430/66, 67, 55, 57

[56] References Cited

U.S. PATENT DOCUMENTS 3,776,627 12/1973 Ohnishi et al. ..... 430/67
3,840,368 10/1974 Ikeda et al. ..... 430/66
3,915,076 10/1975 Gotoda ..... 430/57

FOREIGN PATENT DOCUMENTS 47-26905 7/1972 Japan .
55-9558 1/1980 Japan ..... 430/900

*Primary Examiner*—John E. Kittle
*Assistant Examiner*—John L. Goodrow
*Attorney, Agent, or Firm*—Weinstein & Sutton

[57] ABSTRACT

A photosensitive member for electrophotography comprises a first and a second photoconductive layer sequentially formed on a conductive layer. The first photoconductive layer has a spectral sensitivity extending over a range of light rays from ultraviolet rays to visible light. The second photoconductive layer is of light transmissibility, which is formed with a single or a compound layer and has a filtering action to transmit only light of longer wavelengths than a given one so as to define a range of light incident upon the first photoconductive layer, and a spectral sensitivity only to rays of shorter wavelengths than the given one.

4 Claims, 13 Drawing Figures

FIG. 4 (III)

FIG. 9 (III)

FIG. 10 (III)

FIG 11 (III)

FIG. 12 (II)

FIG. 12 (III)

FIG. 13 (III)

PHOTOSENSITIVE MEMBER FOR ELECTROPHOTOGRAPHY HAVING ULTRAVIOLET ABSORPTION LAYER

BACKGROUND OF THE INVENTION

The invention relates to a photosensitive member for electrophotography which comprises an electrical conductive layer is formed on which a first photoconductive layer having a spectral sensitivity to light rays of longer wavelengths than a given one, on top of which is overlaid a second photoconductive layer having a spectral sensitivity to light rays of shorter wavelengths than a given one.

A photosensitive member for electrophotography of such a structure that a photoconductive layer having a spectral sensitivity to ultraviolet rays and another photoconductive layer having a spectral sensitivity to visible light are laminated on an electrical conductive layer is known in the art.

FIG. 1 and FIG. 2 (I) and (II) show an example of an electrophotographic copying process which uses a conventional photosensitive member of such structure. Such a photosensitive member, as shown in FIG. 1, comprises an electrical conductive layer 1 on which a photoconductive layer 2 for visible light is formed as a charge generating layer, on top of which a polyvinylcarbazole (hereinafter referred to as PVK) layer 3 is laminated. A step for forming an electrostatic latent image on such a photosensitive member belongs to a conventional Carlson process, in which a first step for a uniform charging with a charger 7 is shown in FIG. 2 (I) and a second step for an imagewise exposure 8 is shown in FIG. 2 (II) and are sequentially performed. In case such a photosensitive member is used, however, it should be understood that the PVK layer 3 acts only as a charge holding and migrating layer and is not used positively as a photoconductor of ultraviolet rays.

FIG. 3 shows a structure of another conventional photosensitive member. A photosensitive member shown in FIG. 3 (A) is formed by laminating a photoconductive layer 4 of visible light and a light transmitting insulator layer 5 on an electrical conductive layer 1. Further as an improvement of the photosensitive member mentioned above, a photosensitive member shown in FIG. 3 (B) is formed with a photoconductive layer of ultraviolet rays 6 in place of a light transmitting insulator layer 5 as is known in the art. With the photosensitive members thus constructed, an electrostatic latent image is formed, as shown in FIG. 4, by means of three steps comprising, a step (I) for a uniform charging with a charger 21 in the light or dark, a step (II) for a charging of opposite polarity with a charger 23 or an AC neutralization while in an imagewise exposure 22 and a step (III) for a uniform exposure with visible light 24. For cancellation of the electrostatic latent image after its development and image transfer steps, a step is provided, as shown in FIG. 4 (IV), for an AC neutralization with a neutralizer 25 in the light or dark is used in case of the photosensitive member shown in FIG. 3 (A), while a step, as shown in FIG. 4 (V), for a uniform exposure with ultraviolet rays 26 is used in case of the photosensitive member shown in FIG. 3 (B).

As seen from the foregoing examples, a photoconductive layer of ultraviolet rays operates only as an insulator layer in a process for forming an electrostatic latent image and its spectral sensitivity to ultraviolet rays is not positively utilized for forming an electrostatic latent image. Thus the spectral sensitivity to ultraviolet rays is used only in a step for cancelling an electrostatic latent image.

SUMMARY OF THE INVENTION

It is an object of the invention to provide a photosensitive member for electrophotography having a novel structure adapted to be used in an electrophotographic copying process in which a step for a uniform exposure of ultraviolet rays or rays of short wavelengths is involved during a formation of an electrostatic latent image.

In accordance with the invention, it is possible to provide a photosensitive member for electrophotography having a surface layer in which a charge can be cancelled using only a light irradiation at any time and also function as an insulating layer which is fulfilled under an irradiation of visible light. It is to be understood, therefore, that with a photosensitive layer of the invention an electrostatic latent image which is formed can be cancelled completely without a residual charge by merely applying an irradiation of light rays of short wavelengths such as visible light and/or ultraviolet rays.

Furthermore, a photosensitive member for electrophotography of the invention can hold an electrostatic latent image between a first photoconductive and a second photoconductive layer. Consequently, the electrostatic latent image thus formed does not contact directly with a developer so that a leakage of the charge which defines the latent image does not occur. As a result, it will be appreciated that a plurality of copies can be produced by repeating the use of an electrostatic latent image once formed.

DESCRIPTION OF PREFERRED EMBODIMENTS

Figure 1:
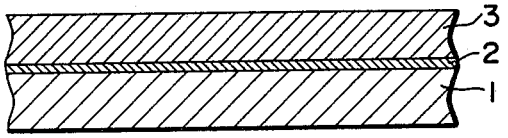
FIG. 1 (PRIOR ART)
FIG. 1 is an enlarged cross section showing an example of a structure of a conventional photosensitive member for electrophotography.
Figure 2:
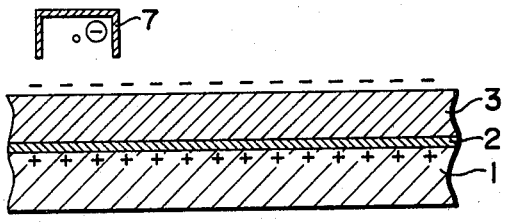
FIG. 2 (I) and (II) are schematic cross sections, illustrating a part of steps in an electrophotographic copying process using the photosensitive member of FIG. 1.
Figure 2:
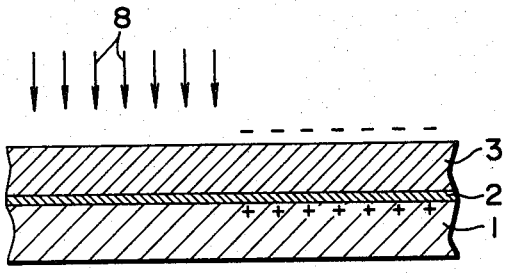
Figure 3:
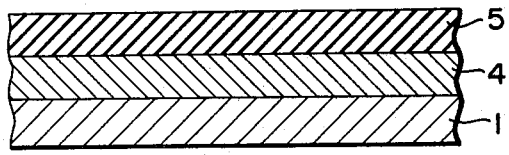
FIG. 3 (A) (PRIOR ART)
FIG. 3 (A) and (B) are enlarged cross sections showing other examples of structures of conventional photosensitive members for electrophotography.
Figure 3:
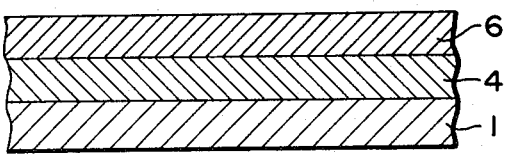
FIG. 3 (B) (PRIOR ART)
Figure 4:
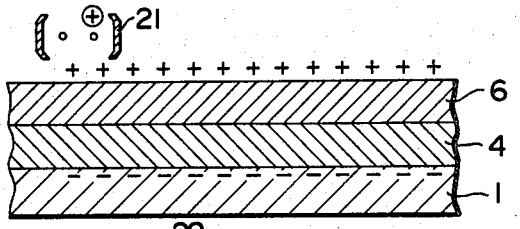
FIGS. 4 (I) to (V) are schematic cross sections, illustrating the steps in an electrophotographic copying process using the photosensitive member indicated in FIG. 3 (B).
Figure 4:
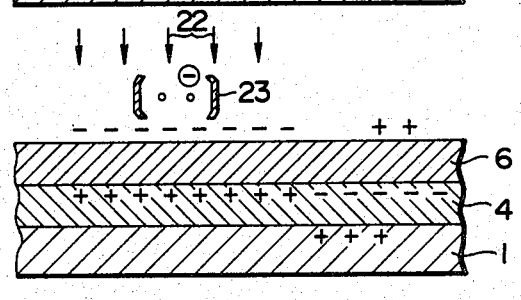
Figure 4:
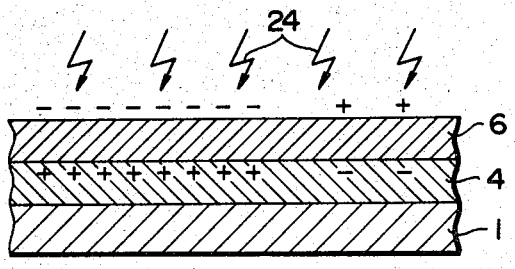
Figure 4:
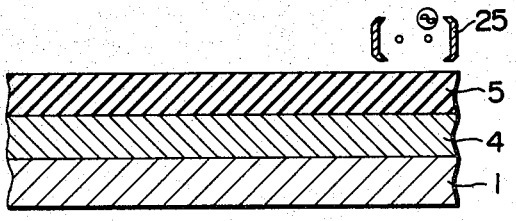
Figure 4:
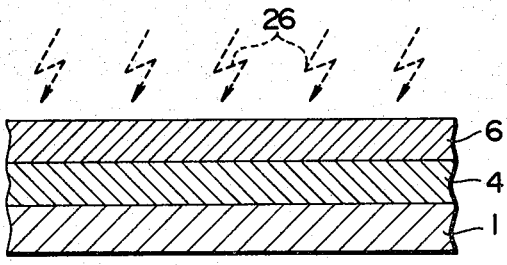
Figure 5:
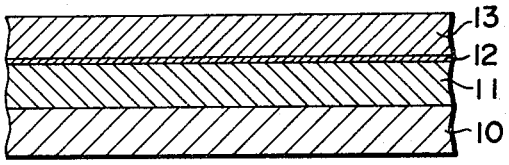
FIG. 5 is an enlarged cross section of a photosensitive member showing an embodiment of the invention.

Referring now to FIG. 5, which is an enlarged cross section of a photosensitive member illustrating an embodiment of the invention, the photosensitive member comprises an electrical conductive layer 10 on which a first photoconductive layer 11 having a sensitivity mainly to visible light is formed, on top of which a second photoconductive layer 13 having a sensitivity mainly to ultraviolet rays is overlaid with a filter layer 12 containing a spectral absorber interposed therebetween. The conductive layer 10 is formed of a metal plate such as aluminium, stainless steel or the like, or a plastic film on which a metal film is formed by vapor coating, or a metal oxide is formed by vapor coating or is applied thereto, or a resin binder into which is dispersed an ionic conductive treating agent, an electric conductive fine powder or the like, or a paper sheet on a surface or inside of which an electric conductive treating agent is applied or impregnated.

Figure 8:
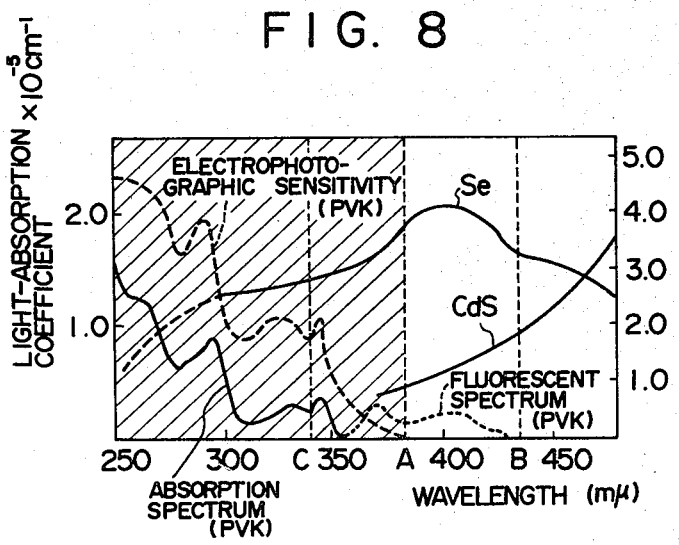
FIG. 8 is a diagram illustrating the spectral sensitivities of Se, CdS and PVK and responses for the absorption spectrum and fluorescent of PVK.

The first photoconductive layer 11 which has a spectral sensitivity in the visible light wavelength region is formed of an organic or inorganic photoconductive material such as Se, Se alloy, amorphous silicon, resin binder into which a fine powder such as CdS or ZnO is dispersed, or vinyl polymer of a carbazole group such as polyvinylcarbazole (PVK) into which a sensitizer such as trinitrofluorenone (TNF) or the like is blended. Of these photoconductive materials, by way of example, spectral sensitivities for an amorphous selenium and a fine powder of CdS dispersed into a resin binder are shown in FIG. 8. It is apparent from FIG. 8 that a photoconductor sensitive to visible light exhibits also a sensitivity to ultraviolet rays.

The second photoconductive layer 13 is to exhibit a spectral sensitivity to light rays of shorter wavelengths than any wavelength within the spectral sensitivity region of the first photoconductive layer 11. To this end, an organic photoconductor which does not contain a sensitizer is suitable. By way of example, a vinyl polymer of a carbazole group such as polyvinylcarbazole, anthracene organic semiconductor which is dispersed into a resin binder, oxadiazole organic photoconductor which is dispersed into a resin binder, one of an anthracene carbazole group or perylene or the like is applicable. As an example of these photoconductor, a spectral sensitivity and an absorption spectrum distribution for PVK are illustrated in FIG. 8.

The filter layer 12 which contains a spectral absorber is formed, for example, by applying an ultraviolet absorber which absorbs rays in an ultraviolet region and is dispersed into a resin. An applicable resin is of a light transmissibility and film formability. By way of example, polyvinylchloride, polymethylmethacrylate, polyethylene, polystyrol, acetyl cellulose and the like which are selected from those applicable can be used. As for a spectral absorber material which is blended into a resin, a yellow color group absorbing shorter wavelength light rays is preferable among ultraviolet ray absorbers and transparent plastic coloring agents. Examples for the ultraviolet ray absorber are phenylsalicylate in a salicylic acid ester group, 2-hydroxyphenylbenzotriazole in a benzotriazole group, 2-hydroxybenzophenone, 2-hydroxy-4-methoxybenzophenone, 2-hydroxy-4-octoxybenzophenone, 2,2'-dihydroxy-4-methoxybenzophenone in a hydroxybenzophenone group, $R_1R_2C{=}CC{\cdot}NR_3$ (where $R_3$ is an electronegative radical) belonging to acrylonitrile substitution products and so on can be used. Since the filter layer is an electric insulator, where its thickness is increased, it will cause an inconvenience such as an increased residual potential by trapping a charge on both sides thereof. To prevent this inconvenience, it is necessary to reduce a thickness of the film layer as much as practicable and also to increase the quantity of a spectral absorber to be blended. As a practical thickness of the filter layer it is preferred to select under several microns in due consideration of the uniformity of application thereof. Assuming that a thickness of the filter layer is one micron, the standard for the quantity of a spectral absorber to be blended to a resin of 100 parts in weight is 5 to 100 parts. Practically the thickness is determined by taking a spectral sensitivity of the first photoconductive layer 11, a luminous intensity of the short wavelength light source to be used in an electrophotographic copying process utilizing the photosensitive member of the invention, a spectral transmitting coefficient of the second photoconductive layer 13, and the like into consideration.

Further, as a structure of filter layer 12 with its thickness increased without an increase of a residual potential, it may be possible to form it by using a resin to be used in the filter layer as a light transmitting photoconductor and blending a spectral absorber thereto. It should be understood that the light transmitting photoconductor must be insensitive to light of long wavelengths and a variety of materials in the foregoing applicable as the photoconductive layer 13 can be used.

When the case is taken for a selection of the spectral sensitivity of the filter layer 12, in which Se is used for the first photoconductive layer 11 and PVK for the second photoconductive layer 13, it may be allowed to determine the one exhibiting the response which absorbs light rays of shorter wavelengths than the wavelength A or 380 mμ within the spectral sensitivity region of Se or the second photoconductive layer 13 and transmitting light rays of longer wavelengths than 380 mμ. In the photosensitive member formed in this manner, when visible light or light of longer wavelengths than 400 mμ is applied toward the second photoconductive layer 13 thereof, the first photosensitive layer 11 or Se may be sensitive to the light while the second photoconductive layer 13 or PVK may operate as an insulator layer as it is insensitive to light of longer wavelengths than 380 mμ. Similarly, when ultraviolet rays of shorter wavelengths than say 350 mμ is applied, the second photoconductive layer 13 or PVK may be sensitive to those rays and operate as a photoconductor while rays of shorter wavelengths than 350 mμ are absorbed by the filter layer 12 containing a spectral absorber and may not reach the first photoconductive layer 11 or Se which therefore operates as an insulating layer. The choice of a spectral light transmissibility of the filter layer 12 may be done by selecting the change point A of a transmission coefficient within an intermediate region between light emission distribution regions of light sources of longer wavelengths and shorter ones to be used in the photoconductive layers 11, 13 and the photosensitive member of the invention. By way of example, in FIG. 8 it may be possible to select the wavelengths at points B and C. As shown in FIG. 8, when the second photoconductive layer 13 emits fluorescent light and its intensity is so strong as to make the first photoconductive layer 11 sensitive, it is required to employ the filter layer 12 having the change point of the light transmission coefficient toward longer wavelengths than that emitting fluorescent light to prevent an arrival thereof at the first photoconductive layer 11. The filter requires a response which has substantially a complete absorption at shorter wavelengths than the change point of the light transmission coefficient and also has a light transmission at longer wavelengths than the change point. However, it may be permissible that the light transmission coefficient is under 100. It will be understood that the photosensitive member of the invention thus formed in the foregoing may be given a novel character in which only the first photoconductive layer 11 is sensitive to light of longer wavelengths than a wavelength A which is optionally determined by a selection of a spectral response of the filter layer 12 while only the second photoconductive layer 13 is sensitive to light of shorter wavelengths than that of A. Also the second photoconductive layer 13 itself is absorptive to ultraviolet rays as well as sensitive thereto. As will be understood from the absorption spectrum shown in FIG. 8, however, its absorption coefficient is not of sufficient magnitude and therefore such a photosensitive member that operates as mentioned above can not be formed without an existence of the filter layer.

Figure 6:
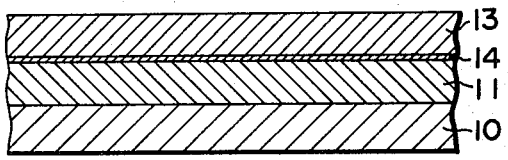
FIGS. 6 and 7 are enlarged cross sections of photosensitive members showing other embodiments of the invention.

FIG. 6 illustrates another embodiment of the photosensitive member of the invention, which is, for the purpose of making the filter layer extremely thin, formed by employing an interference film that the first photoconductive layer 11, interference filter layer 14 and the second photoconductive layer 13 are sequentially laminated on the conductive layer 10. The interference filter layer 14 can be formed usually by a vacuum evaporation method and hence it is possible to form a filter layer with a very uniform thin film.

Figure 7:
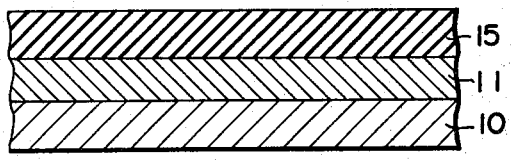

FIG. 7 illustrates a further embodiment of the photosensitive member of the invention, which comprises a surface layer 15 having a function combined both of the filter layer 12 and the second photoconductive layer 13 on the first photoconductive layer 11. The surface layer 15 is formed by uniformly blending a spectral absorber such as ultraviolet ray absorber which absorbs rays of short wavelengths into a photoconductive material which is sensitive only to rays of short wavelengths as seen in a photoconductor of ultraviolet rays. It is to be understood that even with the photosensitive member thus formed, the same function as described above in that of the photosensitive member shown in FIG. 5 can be obtained.

Now a plurality of examples for an electrophotographic copying process which uses the photosensitive member of the invention will be described. The photosensitive member of the invention is to be applied to a specific electrophotography but is not limited to the electrophotography to be described below.

Figure 9:
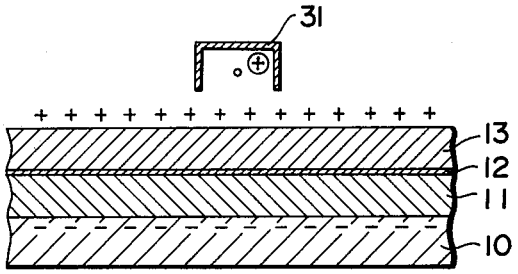
FIGS. 9 to 13 are schematic cross sections, illustrating the steps in electrophotographic copying processes using the photosensitive member of the invention.
Figure 9:
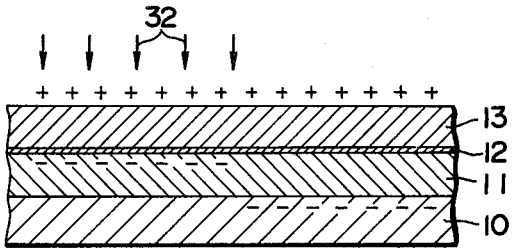
Figure 9:
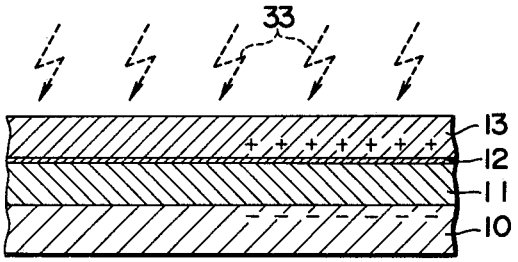
Figure 9:
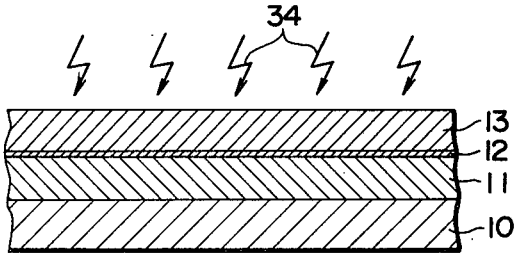

Conventionally, in an electrophotographic copying process in which an electrostatic latent image once formed on a photosensitive member is repeatedly subject to a developing and an image transfer step to produce a plurality of copies, there is a disadvantage that a charge of an electrostatic latent image leaks out through a developer to cause a deterioration thereof. FIG. 9 illustrates the steps of an electrophotographic copying process for the purpose of eliminating such disadvantage which uses the photosensitive member of the invention which forms an electrostatic latent image on an inside layer surface of a photosensitive member comprising compound layers. Either of the photosensitive members shown in FIGS. 5 and 6 is equally applicable but in this instance a copying process with the photosensitive member shown in FIG. 5 will be described.

FIG. 9 (I) shows a step for a uniform charging with a charger 31 in which a charge is uniformly maintained on a surface of the second photoconductive layer 13.

FIG. 9 (II) shows a step for an imagewise exposure 32 in which at a dark area of a light image no migration of a charge occurs while at a bright area thereof a charge of a polarity opposite to the charge maintained on a light irradiating side surface of the second photoconductive layer 13 is trapped on a surface of the first photoconductive layer 11.

FIG. 9 (III) shows a step for a uniform exposure with ultraviolet ray 33 in which all the charge at a region corresponding to the bright area in FIG. 9 (II) disappears while the charge on the surface of the second photoconductive layer 13 at a region corresponding to the dark area migrates toward the light irradiating side surface of the first photoconductive layer 11 to be trapped thereat.

The electrostatic latent image thus formed does not contact directly with a developer during a developing and hence the charge thereof does not leak through a developer, thus permitting it to produce a plurality of good copies with an electrostatic latent image once formed repeatedly used.

The used electrostatic latent image after a given number of copies have been produced can be cancelled in the step for a uniform exposure with visible light 34 as shown in FIG. 9 (IV).

Figure 10:
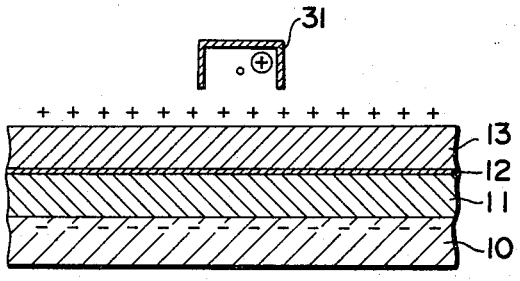
Figure 10:
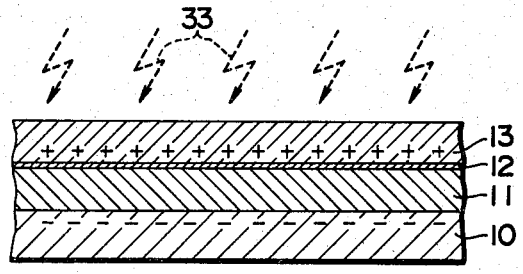
Figure 10:
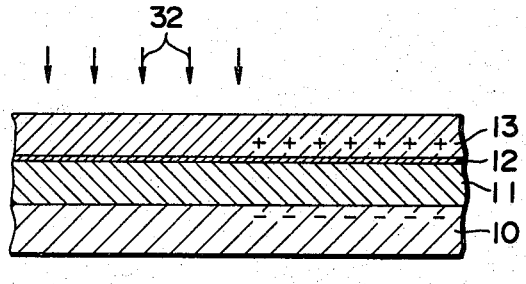
Figure 10:
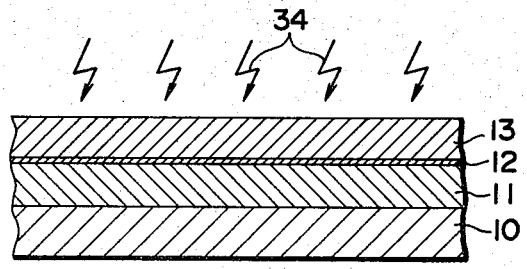

FIG. 10 shows diagrams of a still further process in which the steps for an imagewise exposure and for a uniform exposure with ultraviolet rays in FIG. 9 is reversed in order. All the charge uniformly remained on the surface of the second photoconductive layer 13 in the step for a uniform charging of FIG. 10 (I) migrates toward the light irradiating side surface of the first photoconductive layer 11 in the step for a uniform exposure with ultraviolet ray 33 of FIG. 10 (II) to be trapped thereat. Next, in the step for an imagewise exposure 32 of FIG. 10 (III) the charge at the bright area of the light image disappears and the charge at the dark area thereof is left remained to form the electrostatic latent image, resulting in that the same latent image as that produced upon completion of the step in FIG. 9 (III) is formed. In a similar manner as in FIG. 9, upon completion of a developing and an image transfer step with the electrostatic latent image thus formed, the latent image can be cancelled in the step for a uniform exposure with visible light 34 as shown in FIG. 10 (IV). According to the process shown in FIG. 10 it will be appreciated that the same electrostatic latent image as in FIG. 9 can also be produced and hence the same effects stated in the foregoing may be obtained.

Figure 11:
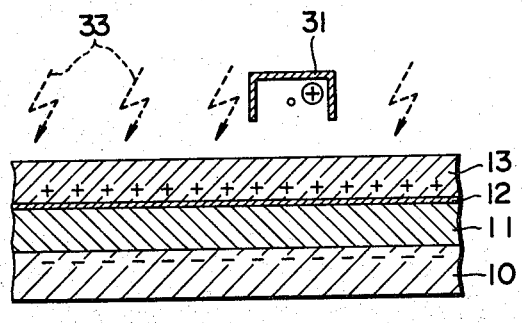
Figure 11:
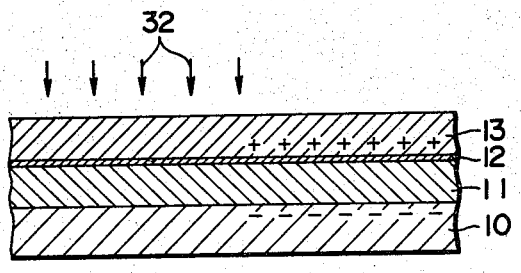
Figure 11:
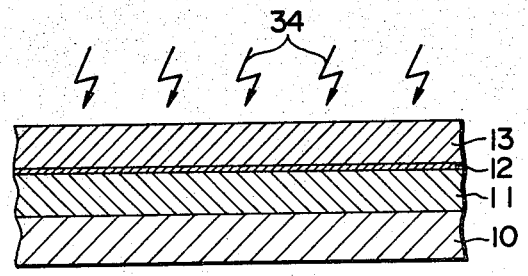

FIG. 11 shows a still further process in which the steps for a uniform charging and for a uniform exposure with ultraviolet ray shown in FIG. 10 are simultaneously performed.

FIG. 11 (I) shows a step for providing simultaneously a uniform exposure with ultraviolet rays 33 and a uniform charging with a charger 31. The state as shown in FIG. 11 (I) is the same as that at the time the step in FIG. 10 (II) has completed and the steps in FIGS. 11 (II) and (III) are the same as those in FIGS. 10 (III) and (IV).

Figure 12:
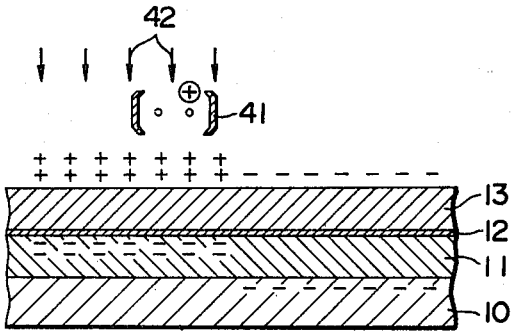
Figure 12:
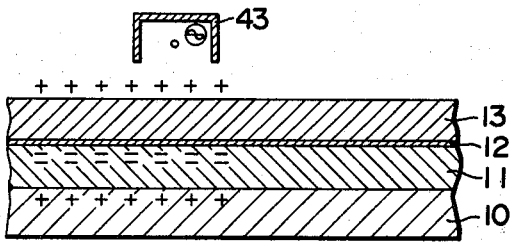
Figure 12:
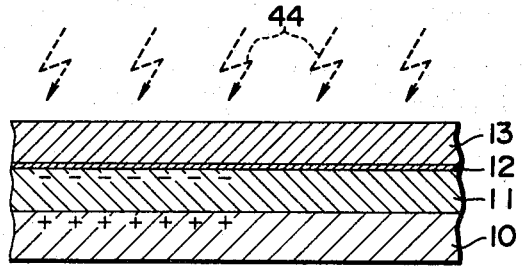
Figure 12:
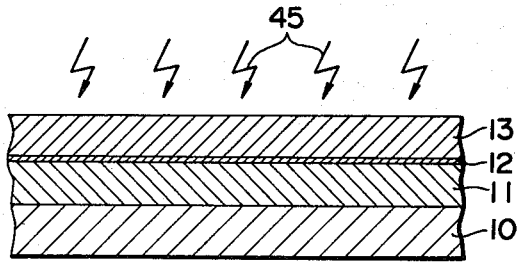
Figure 13:
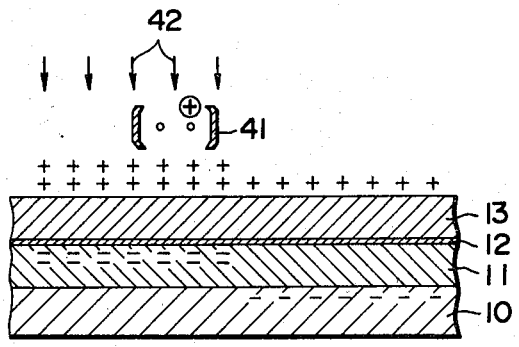
Figure 13:
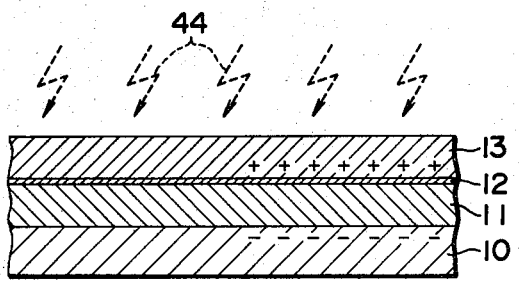
Figure 13:
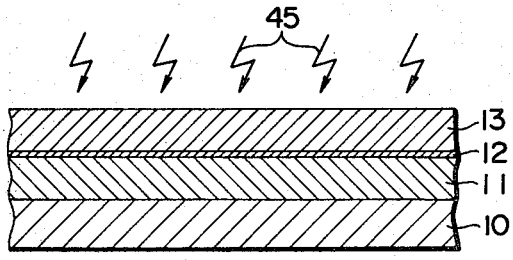

FIGS. 12 and 13 show still further processes which use the photosensitive member of the invention.

A purpose of these electrophostatic copying process is to realize a method adapted to form an electrostatic latent image negative to a light image or the one preferable to a plurality of copying with the same latent image.

FIG. 12 (I) shows a step for a uniform charging with a charger 41 while in an imagewise exposure 42. At a dark area of a light image, a charge is trapped on a surface of the second photoconductive layer 13 and a charge of polarity opposite to the former is induced on a surface of the conductive layer 10. At a bright area of a light image, charges of polarities opposite to each other are trapped on a surface of the second photoconductive layer 13 and on a light irradiating side surface of the first photoconductive layer 11, respectively. Since the charge trapped at the bright area is more than that trapped at the dark area, it is preferable that a sufficient charging be provided until surface charges at each layer are substantially equal to each other or the same surface potential are forcibly obtained with a scotron charger.

FIG. 12 (II) shows a step for a uniform neutralization in the dark with an AC corona charger 43 or a corona charger with a polarity opposite to that in FIG. 12 (I), which is operated until the surface potential becomes 0 V. As a result, at the dark area no charge exists in any region of the photosensitive member while at the bright area the charge on the light irradiating side surface of the first photoconductive layer 11 is left trapped and as the surface charge on the second photoconductive layer 13 decreases, a charge of the same amount equal and a polarity opposite to the charge thus decreased is induced on the surface of the photoconductive layer 10.

Next, FIG. 12 (III) shows a step for a uniform exposure with ultraviolet rays 44, in which a surface charge on the second photoconductive layer 13 and a charge on the light irradiating side surface of the first photoconductive layer 11 which has the same amount of the former disappear with other charges remained, thus forming an electrostatic latent image.

The latent image thus formed is a negative electrostatic one which has a potential at the bright area of the light image and a surface of which is covered with the second photoconductive layer 13, thus being adaptable to apply to a process for producing a plurality of copies. The used electrostatic latent image may be cancelled by applying a uniform exposure with visible light 45 as shown in FIG. 12 (IV).

FIG. 13 shows steps for forming a positive electrostatic latent image without using the step for a uniform neutralization in the dark as shown in FIG. 12 (II). The step in FIG. 13 (I) is the same as that in FIG. 12 (I). All the charge trapped on both sides of the second photoconductive layer 13 disappears in response to the bright area of the light image in the step of FIG. 13 (II) and no charge remains in any area of the photosensitive member at a region corresponding to the bright area in FIG. 13 (I). At a region corresponding to the dark area of the light image, all the charge on the surface of the second photoconductive layer 13 migrates toward the light irradiating side surface of the first photoconductive layer 11 to form an electrostatic latent image. The latent image is the one positive to the light image which has a charge at the dark area and the surface thereof is covered with the second photoconductive layer 13, therefore being preferable to apply to an electrophotographic copying process for producing a plurality of copies. The used electrostatic latent image can be cancelled by a uniform exposure with visible light 45 in the step shown in FIG. 13 (III).

In the foregoing, a number of electrophotographic copying processes which use the photosensitive member of the invention are described. A specific feature common to these processes is to include a step for a unifrom exposure of short wavelength light rays such as ultraviolet ray in the process for forming an electrostatic latent image. In case the electrostatic latent image is formed in such step, it is an essential condition that the short wavelength light acts separately only on the second photoconductive layer but does not act on the first photoconductive layer which is sensitive to long wavelength light. The reason is that assuming the first photoconductive layer, sensitive to long wavelength light, has responded to short wavelength light when irradiated with it, all the charge thereon disappears, enabling to form an electrostatic latent image no longer.

What is claimed is:

1. A photosensitive member for electrophotography, comprising :

a first photoconductive layer formed on a conductive layer and having a range of photoconductive response extending over a range of light rays from ultraviolet rays to visible light;

a filter layer for absorption of ultraviolet rays formed on the first photoconductive layer;

a second photoconductive layer of light transmissibility formed on the filter layer of ultraviolet absorption and being sensitive only to ultraviolet rays; and said photosensitive member functioning to hold the charge which defines an electrostatic latent image between said first and second photoconductive layers to avoid said charge directly contacting a developer.

2. A photosensitive member for electrophotography according to claim 1 in which the filter layer is formed with an interference filter layer.

3. A photosensitive member for electrophotography according to claim 1 in which the filter layer of ultraviolet absorption includes an ultraviolet ray absorber and a light transmitting resin.

4. A photosensitive member for electrophotography according to claim 3 in which the light transmitting resin includes a light transmitting photoconductor.

* * * * *

UNITED STATES PATENT AND TRADEMARK OFFICE

CERTIFICATE OF CORRECTION

PATENT NO. : 4,420,547

DATED : December 13, 1983

INVENTOR(S) : Masaji Nishikawa

It is certified that error appears in the above-identified patent and that said Letters Patent is hereby corrected as shown below:

Column 8, line 12, "unifrom" should read -- uniform --.

Signed and Sealed this

*Sixth* Day of *November 1984*

[SEAL]

*Attest:*

GERALD J. MOSSINGHOFF

*Attesting Officer*

*Commissioner of Patents and Trademarks*